US007596904B1

(12) United States Patent
Jones

(10) Patent No.: US 7,596,904 B1
(45) Date of Patent: Oct. 6, 2009

(54) VASE WITH GREETING CARD DISPLAY

(76) Inventor: Micaiah Jones, 5000 Freter Rd., Sykesville, MD (US) 21784

( * ) Notice: Subject to any disclaimer, the term of this patent is extended or adjusted under 35 U.S.C. 154(b) by 625 days.

(21) Appl. No.: 11/362,934

(22) Filed: Feb. 27, 2006

Related U.S. Application Data

(60) Provisional application No. 60/659,754, filed on Mar. 9, 2005.

(51) Int. Cl.
*A47G 7/06* (2006.01)

(52) U.S. Cl. ..... 47/41.01; 40/124.4

(58) Field of Classification Search ..... 47/41.01, 47/84, 72; 40/124, 124.4, 124.5, 666; D19/77; 211/45; D20/21
See application file for complete search history.

(56) References Cited

U.S. PATENT DOCUMENTS 1,958,790 A * 5/1934 Jippson ..... 47/41.1
D165,272 S * 11/1951 Dioguardi ..... D11/144
3,789,526 A * 2/1974 Lavinson ..... 40/124
4,662,107 A 5/1987 Van Den Kieboom
4,852,280 A * 8/1989 Beattie ..... 40/124
5,088,216 A * 2/1992 Wasilko ..... 40/124.4
D353,840 S * 12/1994 Dietterich et al. ..... D19/85
5,687,503 A 11/1997 D'Costa
6,543,183 B1 4/2003 McNaughton

FOREIGN PATENT DOCUMENTS

DE 3805240 A1 * 8/1999

* cited by examiner

*Primary Examiner*—Francis T Palo

(57) ABSTRACT

An apparatus for displaying flowers and a greeting card is provided. The greeting card has an open end and a closed end. The apparatus comprises a hollow vase having an outer surface, a top end, and a bottom end. An opening is formed in the top end of the vase with the opening extending from the top end of the vase to the bottom end of the vase. A slot is formed in the outer surface of the vase with the slot extending from the top end of the vase to the bottom end of the vase and the slot sized and shaped for receiving the closed end of the greeting card.

6 Claims, 1 Drawing Sheet

VASE WITH GREETING CARD DISPLAY

The present application claims benefit of priority of pending provisional patent application Ser. No. 60/659,754, filed on Mar. 9, 2005, entitled "Vase With Card Display".

BACKGROUND OF THE INVENTION

1. Field of the Invention

This invention relates generally to vase and, more particularly, the invention relates to vase having a slot for displaying a greeting card in a substantially upright manner.

2. Description of the Prior Art

A popular way in which many consumers show they care for another person is to present that person a small token of love or appreciation. Whether given as a simple pick-me-up to a friend who has endured an extended stay in the hospital, offered to a small child after a tough day at school, or present to one's sweetheart on St. Valentine's Day, a carefully chosen gift can brighten virtually anyone's day. Perhaps two of the most popular tokens to give and receive are flowers and greeting cards. While flowers especially appeal to women, a carefully handpicked greeting card can melt the heart of female and male consumers alike. Providing a thoughtful way in which to say, "I care", these types of mementos will surely always b popular amongst consumers of all ages.

SUMMARY

The present invention is an apparatus for displaying flowers and a greeting card. The greeting card has an open end and a closed end. The apparatus comprises a hollow vase having an outer surface, a top end, and a bottom end. An opening is formed in the top end of the vase with the opening extending from the top end of the vase to the bottom end of the vase. A slot is formed in the outer surface of the vase with the slot extending from the top end of the vase to the bottom end of the vase and the slot sized and shaped for receiving the closed end of the greeting card.

In addition, the present invention includes, in combination, a greeting card having an open end and a closed end and a hollow vase having an outer surface, a top end, and a bottom end. An opening is formed in the top end with the opening extending from the top end to the bottom end. Greeting card retention means are formed in the outer surface of the vase and extending from the top end of the vase to the bottom end of the vase.

The present invention further includes a method for displaying a greeting card with a vase. The method comprises providing a greeting card having an open end and a closed end, providing a vase having an outer surface, a top end, and a bottom end, forming an opening in the top end of the vase, extending the opening from the top end of the vase to the bottom end of the vase, forming a slot in the outer surface of the vase, and extending the slot from the top end of the vase to the bottom end of the vase.

DETAILED DESCRIPTION OF THE PREFERRED EMBODIMENTS

Figure 2:
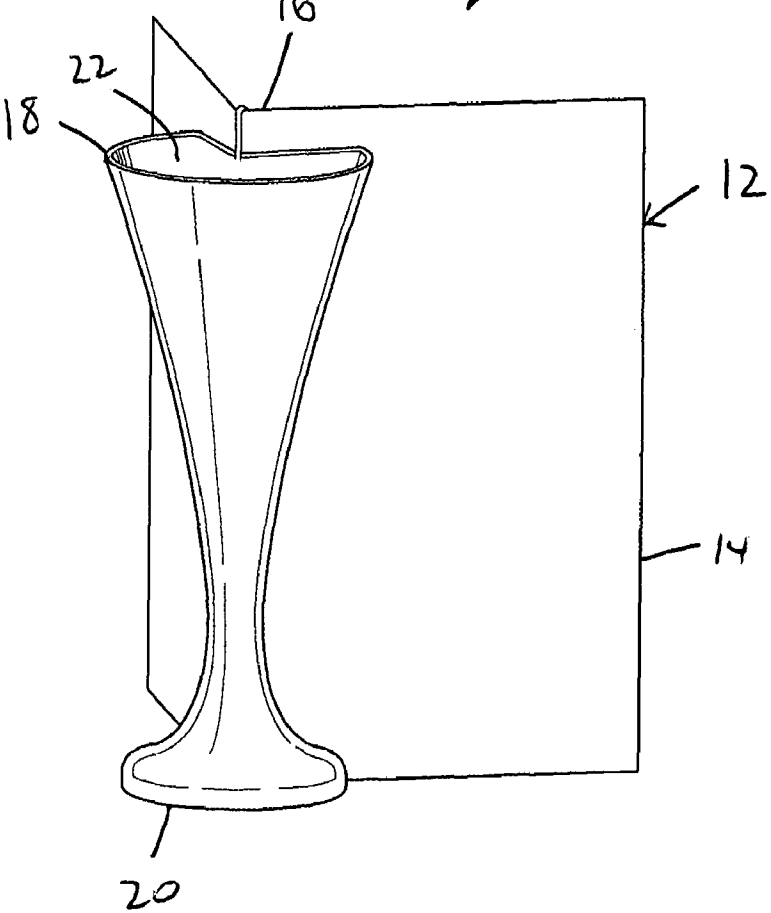
FIG. 2 is a rear perspective view illustrating the vase with greeting card display of FIG. 1, constructed in accordance with the present invention.
Figure 1:
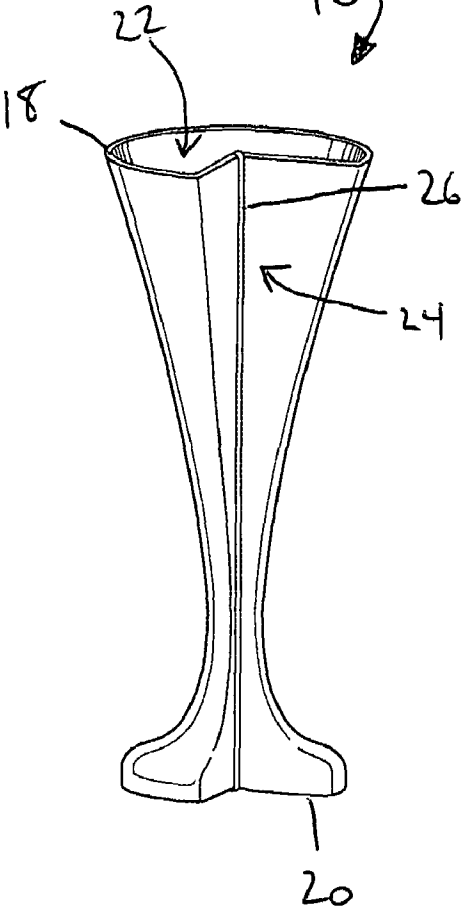
FIG. 1 is a front perspective view illustrating a vase with greeting card display, constructed in accordance with the present invention.

As illustrated in FIG. 1, the present invention is a vase, indicated generally at 10, having a card display for both holding flowers (not shown) and displaying a greeting card 12 having an open end 14 and a closed end 16. Basically, the vase 10 of the present invention with greeting card 12 is a decorative vase 10 boasting a specially designed holder for use in displaying the greeting card 12 in an open manner.

The vase 10 of the present invention is generally cylindrical in shape although any shape is within the scope of the present invention. The vase 10 can be constructed from a variety of materials including, but not limited to, plastic, Plexiglas, polished glass, ceramic, crystal, and stainless steel. In addition, the vase 10 can also be produced in a range of attractive shapes, colors, and patterns to meet the decorative needs and gift giving themes of various users. It should be noted that the listing of materials and/or shapes herein for construction of the vase 10 is not meant to be limiting and constructing the vase 10 from any material is within the scope of the present invention.

The vase 10 of the present invention has a top end 18 and a bottom end 20. The top end 18 includes a receptacle 22 for holding and storing a bouquet of fresh flowers and hydrating water. The bottom end 20 of the vase 10 is designed and shaped as a base for setting the vase 10 on a substantially horizontal surface.

Running the length of the exterior of the vase 10 from the top end 18 of the vase 10 to the bottom end 20 of the vase 10 is a substantially triangular shaped, recessed niche or slot 24 tapered to form an approximately ninety (90°) degree angle designed and shaped for receiving a closed end of the upright greeting card 12. In a preferred embodiment, running the length of the slot 24 is a colorful, stretchy elastic string 26 securely attached to the top end 18 and the bottom end 20 of the vase 10 within the slot for further securing about the closed end 16 the greeting card 12. The elastic string 26 is received within the closed end 16 of the greeting card 12 thereby maintaining the greeting card 12 in a substantially upright manner.

The greeting cards 12 for use with the vase 10 can be created specifically for the vase 10 or could be a standard, conventional greeting card 12 available on the market. The vase 10 can be packaged with pre-filled fresh flowers, or the vase 10 can be sold empty to the user to be filled by the user.

The use of the vase 10 of the present invention will now be described. As understood by those persons skilled in the art, other manners of use of the vase 10 are within the scope of the present invention.

First, a user purchases the vase 10 and greeting card 12 and shares it with a desired person as a thoughtful gift or keeps it for them as a delightful "pick me up" with the greeting card 12 secured to the elastic string 26 as described above. By way of example, a parent might share a simple glass vase 10 filled with colorful carnations and boasting a greeting card 12 which exclaims love and pride, as a congratulatory gift to a child who has done well on their report card. Alternatively, the sleek vase 10 of the present invention, filled with brilliant red roses accompanied with the greeting card 12 bearing the message "Happy Anniversary" provides a delightful gift from a man to his wife on the anniversary of their marriage. The vase 10 with greeting card 12 can also be given at any holiday or birthday celebration, as well as provide a unique party favor at a friendly gathering.

The vase 10 with greeting card 12 display offers user a unique and novel means of showing another they care.

Through beautiful flowers and a thoughtful greeting card 12, the vase 10 of the present invention conveys a sense of friendship or love when given or received. Fun to share with children, teens, and adults, the vase 10 with greeting card 12 display is a thoughtful memento for users of all ages. Placed on a bookshelf, countertop, or table, the vase 10 with card display offers users a delightful accent piece to brighten any room décor. Securely displaying the greeting card 12 in an upright manner, the vase 10 eliminates the scenario of putting a treasured greeting card 12 out for display; only to have that greeting card 12 repeatedly fall over due to lack of stability and support.

Ideal for use in displaying a fresh bouquet of flowers, the unique design of the vase 10 enables users to utilize the vase 10 for a variety of purposes. Filled with colorful party balloons and used to adorn a birthday centerpiece, the vase 10 also provides the perfect office storage tool, providing an attractive hold in which pens, pencils, scissors, and similar accessories can be neatly stored. Versatile in function, the vase 10 can be displayed without or without a greeting card attached, enabling the user to utilize this vase long after the special occasion on which it was received has passed.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An apparatus for displaying flowers and a greeting card on a flat surface, the greeting card having an open end and a closed end, the apparatus comprising:

a single piece hollow vase having an outer surface, a top end, and a bottom end;

an opening formed in the top end of the vase, the opening extending from the top end of the vase to the bottom end of the vase; and a slot formed in the outer surface of the vase, the slot extending from the top end of the vase to the bottom end of the vase, the slot sized and shaped for receiving the closed end of a greeting card and allowing the greeting card to be displayed in an open position and resting upon the flat surface supporting the vase.

2. The apparatus of claim 1 wherein the slot has a first wall and a second wall, the first wall connecting to the second wall at a ninety (90°) angle.

3. The apparatus of claim 1 and further comprising:

securing means for releasably securing the greeting card within the slot.

4. The apparatus of claim 3 wherein the securing means is an elastic string and the slot has a first wall and a second wall, the elastic string extending the length of the slot from the top end to the bottom end along the connection of the first wall with the second wall.

5. In combination:

a greeting card having an open end and a closed end;

a single piece hollow vase having an outer surface, a top end, and a bottom end;

an opening formed in the top end, the opening extending from the top end to the bottom end; and a slot sized and shaped for receiving the closed end of the greeting card, the slot having a first wall and a second wall;

an elastic string extending the length of the slot from the top end to the bottom end along the connection between the first wall and the second wall;

wherein the greeting card is displayed in an open position and resting upon the surface supporting the vase.

6. The combination of claim 5 wherein the slot has a first wall and a second wall, the first wall connecting to the second wall at a ninety (90°) angle.

* * * * *